US005140310A

United States Patent [19]

DeLuca et al.

[11] Patent Number: 5,140,310

[45] Date of Patent: Aug. 18, 1992

[54] INTERRUPTING LOW BATTERY INDICATOR

[75] Inventors: Michael J. DeLuca, Boca Raton; Pamela A. Rakolta, Lake Worth, both of Fla.

[73] Assignee: Motorola, Inc., Schaumburg, Ill.

[21] Appl. No.: 442,750

[22] Filed: Nov. 29, 1989

[51] Int. Cl.[5] ..... G08B 21/00

[52] U.S. Cl. ..... 340/636; 340/825.44; 320/48; 324/427

[58] Field of Search ..... 340/636, 825.44; 368/66; 324/427, 433; 320/48

[56] References Cited

U.S. PATENT DOCUMENTS 3,998,043 12/1976 Tamuru et al. ..... 368/228 X
4,280,208 7/1981 Nomura ..... 368/66
4,713,808 12/1987 Gaskill et al. ..... 370/93 X

*Primary Examiner*—Jin F. Ng
*Assistant Examiner*—Jeffery A. Hofsass
*Attorney, Agent, or Firm*—William E. Koch; Vincent B. Ingrassia

[57] ABSTRACT

An electrical device has a display and a battery which has a varying electrical condition. The display typically displays information to be read by the user of the device. In response to a low battery detection, the information being displayed may be interrupted with information indicating the battery is low. The timing of the interruption increases as the battery nears depletion thereby giving user an indication of the remaining battery capacity. The variation in timing includes either increasing the duty cycle of the periodic interruption, decreasing the period of the interruption, or both. The electrical device may include a wrist watch paging receiver with a message display and a clock with time of day and date functions.

24 Claims, 5 Drawing Sheets

DUTY CYCLE OF "LOW CELL" DISPLAY WHILE DISPLAYING TIME

DUTY CYCLE OF "LOW CELL" DISPLAY WHILE DISPLAYING MESSAGES AND WHILE ALERTING

INTERRUPTING LOW BATTERY INDICATOR

BACKGROUND OF THE INVENTION

This invention relates generally to the area of a power supply indicator used in conjunction with an electrical device. More particularly, this invention relates to an improved low battery indicator for use, though not exclusively, with a wrist watch paging receiver.

Paging receivers and wrist watches are electrical devices which are powered by battery power supplies. As the battery discharges a paging receiver generates a low battery indication. In many cases, paging receivers continue to operate properly for several days after the low battery indication. It is desirable to enable the user of the paging receiver to expend the total capacity of the battery remaining after the low battery indicator while still providing ample low battery indications in order that a new battery or a battery recharge may be obtained.

With the advent of lower power and smaller paging receivers incorporated together with wrist watch functions, the feasibility of smaller, lower capacity batteries is becoming apparent. Such batteries suffer from irregular performance towards the end of the life of the battery. Current pagers use many types of battery technologies such as nickel-cadmium, alkaline, carbon-zinc, mercury and zinc-air. Each battery technology has different characteristics, particularly towards the end of the life of the battery. Additionally, advances in the battery manufacturing industry are continually improving battery performance. For example, today's alkaline battery has substantially more capacity than the alkaline battery of just two years prior.

Prior art low battery indicators used with pagers have operated simply to display the text "LOW CELL" or "LO CELL", or an annunciator or low battery icon when the battery voltage reaches a predetermined voltage. Still other low battery indicators generate only a short tone burst, which if not heard by the user may go unnoticed. Yet still another low battery indicator generates a continuous alert tone. These prior art low battery indicators provide no indication as to the time since the low battery state has been detected, and further provide no means for determining the battery capacity remaining.

Additionally, in miniature display applications, it is desirable to provide a "LO CELL" indication in the same area used to convey other information. This is particularly true in applications such as digital watches or watches having paging receivers incorporated therein, wherein the display area is very small. The display of a "LO CELL" indication may displace the display of time, date or message information. Thus it is desirable to provide for both the display of low cell information while providing for the display of time, date or message information. Is further desirable to make such a provision in a manner that provides for an indication of the remaining capacity of the battery.

SUMMARY OF THE INVENTION

It is therefore an object of the present invention to overcome the aforementioned disadvantages and realize the aforementioned desires.

It is an object of the present invention to vary the timing of the display of a low cell icon in response to the determined remaining capacity of a battery.

It is an object of the present invention to provide a display that displays first information when a battery has substantial remaining capacity, and to interrupt the first information at a rate corresponding to the remaining battery capacity with second information in response to the detection of a low battery.

It is a further object of the invention to vary the rate of the interruption in response to the type of information being displayed.

In accordance with the invention, an information display device comprises: sensing means for sensing an electrical signal having a varying electrical condition and for producing a capacity signal in response thereof; and activating means for activating the display of information for a variable timing responsive to the capacity signal, whereby the timing of the activation indicates a status of the varying electrical condition.

In accordance with the invention, an information display device comprises: display means for displaying first information; sensing means for sensing an electrical signal having a varying electrical condition and for producing a capacity signal in response thereof; and interrupting means for interrupting the displaying of the first information with a displaying of second information for a variable timing responsive to the capacity signal, whereby the timing of the interruption indicates a status of the varying electrical condition.

In further accordance with the present invention, a method indicates the status of an electrical signal upon an information display device, the method comprising the steps of: sensing an electrical signal having a varying electrical condition; generating a threshold signal in response to the varying electrical condition exceeding predetermined condition; displaying first information on a display means; interrupting the displaying of the first information on said display means with a displaying of second information at a first rate in response to the threshold signal; displaying third information on said display means; and interrupting the displaying of the third information on said display means with a displaying of second information at a second rate different from the first rate in response to the threshold signal.

DESCRIPTION OF A PREFERRED EMBODIMENT

Figure 1:
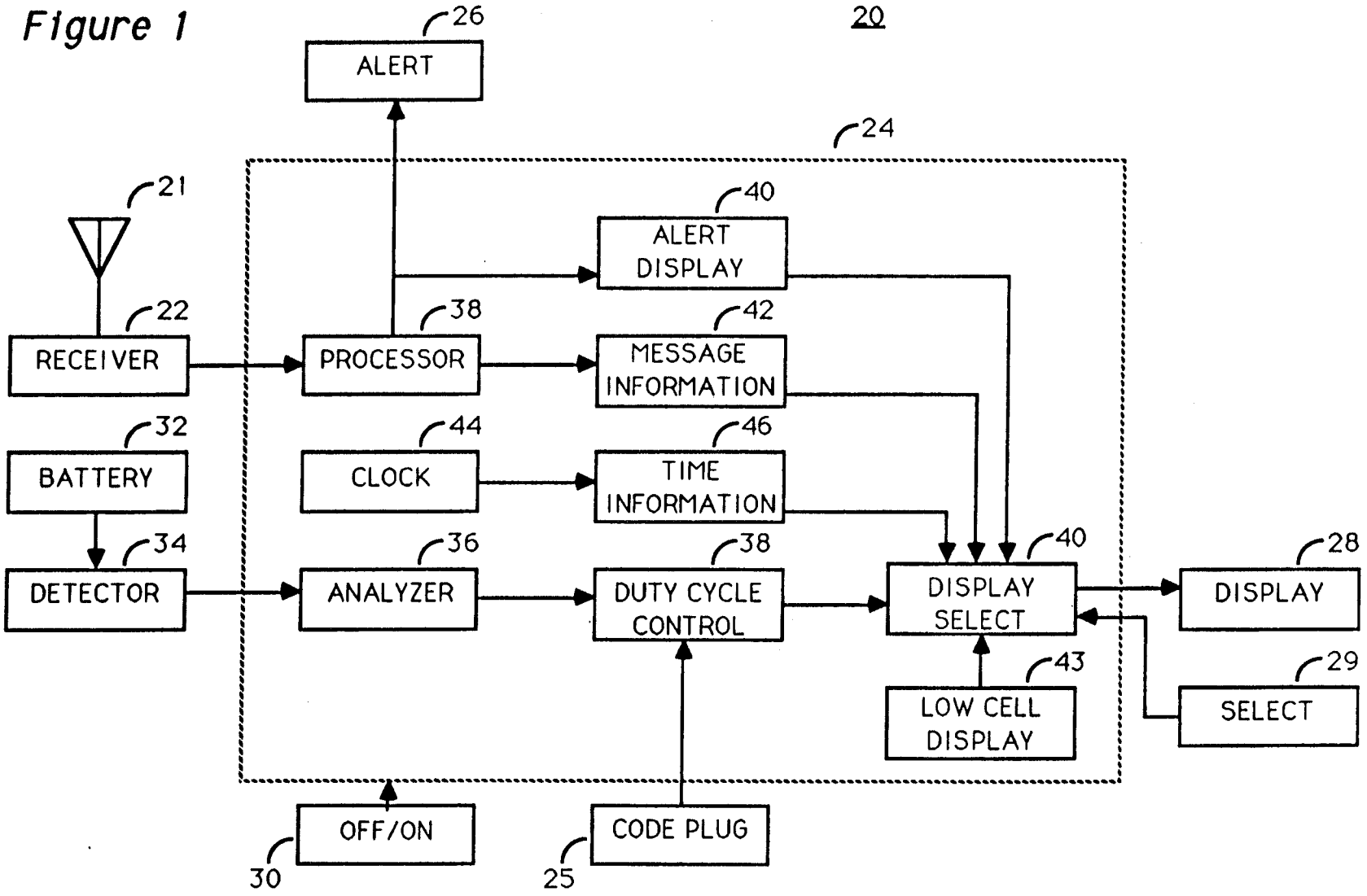
FIG. 1 shows a block diagram of wrist watch paging receiver device operating in accordance with the present invention.

FIG. 1 shows a block diagram of wrist watch paging receiver device operating in accordance with the present invention. Device 20 includes an antenna 21 and a receiving means 22 which receives and demodulates paging information modulated upon an RF carrier. The paging information may be included within one of several known paging protocols such as the GSC or POCSAG paging protocols. The demodulated information is decoded by decoding means 24. Code plug 25 contains an address assigned to the paging receiver and other information directing the operation of the device. If an address matching an address assigned to the paging receiver is decoded, an audio or vibrating alert is generated on alert means 26 and a corresponding display is generated on display means 28. If the address has message information associated with it, the message information may be displayed on message display means 28.

Display means 28 additionally provides time of day and date information in response to a selected mode of operation. The selected mode of operation is determined in response to select means 29 which may comprise at least one manually operated mechanical switch. Selecting means 29 provides for resetting an alert signal, selecting and displaying a message, and selecting either a time or date display. The display means 28 is preferably comprised of a liquid crystal display (LCD) capable of displaying either 9 numeric characters in one embodiment or 12 numeric or 16 alpha-numeric characters in alternate embodiments. In yet another alternative embodiment the display may encompass either a multi-line display or a graphic display. In still another embodiment, the display means 28 may include a separate icon for indicating a low cell condition. Such an embodiment may be used in an application providing for a display means large enough to include extra display information.

OFF/ON switch 30 disables and enables the process of receiving and demodulating information by the paging receiver. The paging receiver is powered by a power supply means or battery 32, which has a varying electrical condition, or output voltage which varies as the capacity of the battery is utilized by the device. The electrical condition of the battery is sensed by a detecting means 34 which includes a voltage comparison means for comparing the battery voltage with a predetermined voltage and generating a signal in response to the equality. The output of the sensing means is coupled to an analyzing means 36 which in a first embodiment, generates an indication of the elapsed time since the sensing or detection of the low battery, in a second embodiment generates an indication of the battery voltage, or in a third embodiment, monitors the operation of the means 22, 24, 26, 28, and 30 in order to produce a signal indicative of the power consumed since the low battery.

The output of analyzer 36 is used by duty cycle controller 38 to adjust the timing of the interruption of a display selected by display select 40 with a low cell display 42. The timing of the display interruption preferably has a fixed period of one second and has a duty cycle ranging from 25 mS to 950 mS depending upon the determined remaining battery capacity, the type of information selected for display, and a capacity value stored in the code plug 25. In alternate embodiments, either the period, or the period and the duty cycle of the low cell may be modified. The information displayed during the low cell interruption may be the text "LOW CELL" or "LO CELL" or may be a capacity value. U.S. patent application Ser. No. 07/342,768 to Henry et al. and assigned to the assignee of the present invention shows displaying of a value indicative of the remaining capacity of a battery and is hereby incorporated by reference. In an alternate embodiment wherein the display means 28 includes a separate icon for indicating a low cell condition the icon is switched OFF and ON aforementioned timing.

Processor 38 compares the received information with the address within code plug 25 and causes an alert to be generated by means 26. Additionally, an alert display 40 is determined in response to the message and may include the text "1 PAGE", "2 PAGES" . . . "n PAGES" where n indicates the number of unread pages, or alternately may contain a display indicative of the source of the message, or may contain the text "CALL". Subsequent message information is stored in memory means 43 for subsequent display.

Clock means 44 comprises a time keeping means which generates time of day and date information 46 for display on display means 28. The clock means may additionally generate an alert display in response to an alarm time being in coincidence with the time of day.

The decoder 24, including the means shown enclosed within the dashed line indicated by 24 may be implemented in a host microcomputer. A preferred microcomputer is the Motorola MC68HC05L8. U.S. Pat. No. 4,755,816 to DeLuca shows a microcomputer controlled pager and U.S. Pat. No. 4,872,005 to DeLuca et al. shows a paging receiver having time keeping functions, these patents further support the enabling description of the invention presented herein and are hereby incorporated by reference.

Storing the capacity value within the code plug allows the value to be adjusted in response to improvements in battery technology. Thus a currently manufactured zinc-air battery is expected to provide five days of device operation after the detection of a low cell condition. In one information display mode, the display is interrupted every second (1000 mS) with a low cell display, the display varies in duration from 100 mS at the beginning of the first day to 950 mS at the end of the fifth day. As the technology improves, the operating time during the low cell condition time may double or triple. The capacity value may be modified such that the 950 mS interruption is not reached until either the tenth or fifteenth day in response to the improvements in technology. Additionally, several capacity values may be stored in the code plug, one for each battery technology expected to be used by the device. For example a capacity value corresponding to three days could be selected in response to the use of an alkaline battery, or a capacity value of four hours could be selected in response to the use of a nickle-cadmium battery. The selection of the capacity value could be made in response to a means for determining the size of the battery, wherein each battery technology has a different size, or in response to a manual selection by the operator of the device.

Figure 2:
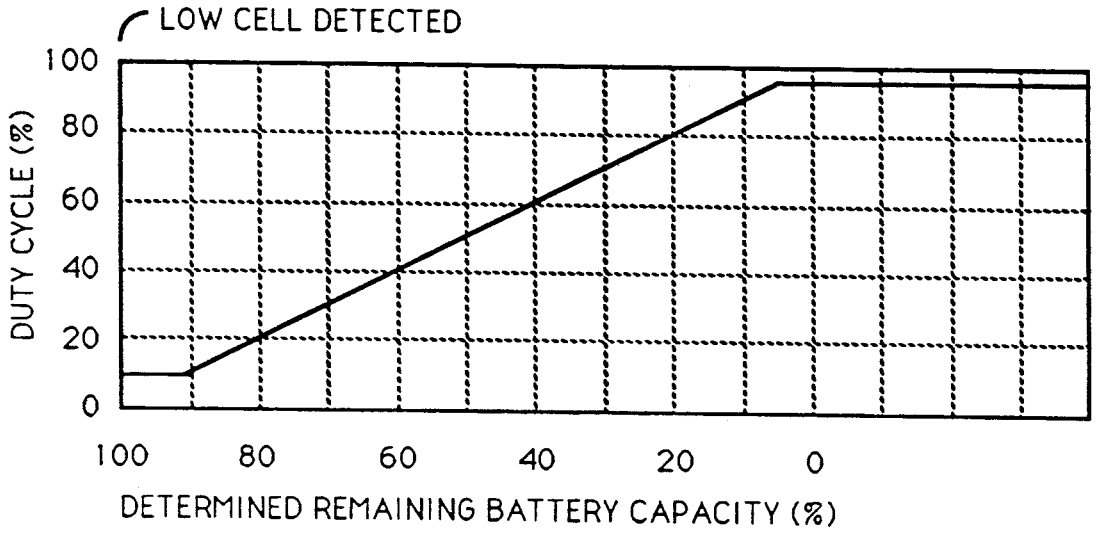
FIG. 2 shows the variation in duty cycle of a low cell display interruption in response to the determined remaining battery capacity while time of day or date information is being displayed.

FIG. 2 shows the variation in duty cycle of a low cell display interruption in response to the determined remaining battery capacity while time of day or date information is being displayed. The horizontal scale indicates the the determined remaining battery capacity expressed in units of "%". Methods for determining the remaining capacity will be described in FIGS. 6, 7 and 8. The vertical scale indicates the duty cycle of the low cell display interruption in response to the remaining capacity. The 100% remaining capacity corresponds to the detection of a low cell condition which is preferably in response to the battery voltage substantially being between 1.2 and 1.1 volts. At this point, the duty cycle corresponds to 10% of the period of the interruption. When the remaining capacity is between 90% and 5%, the duty cycle increases from 10% to 95% in a substantially linearly manner. Thereafter, the duty cycle remains at 95%.

Figure 3:
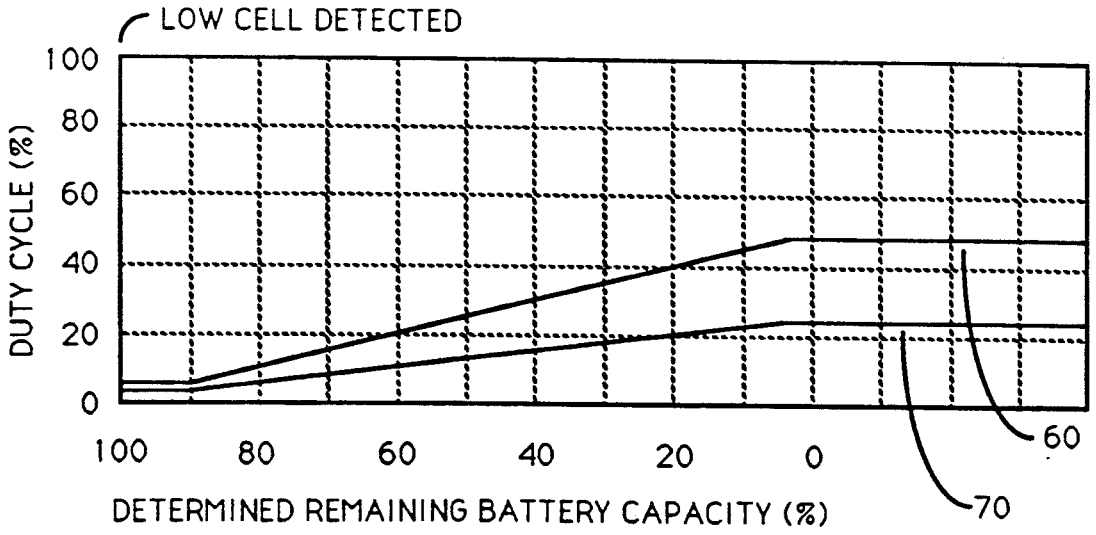
FIG. 3 shows the variation in duty cycle of a low cell display interruption in response to the determined remaining battery capacity while a message is being displayed and while an alert is being generated.

FIG. 3 shows the variation in duty cycle of a low cell display interruption in response to the determined remaining battery capacity while a message is being displayed and while an alert is being generated. The vertical and horizontal axis correspond to those of FIG. 2. Line 60 of FIG. 3 shows that the duty cycle of the low cell interruption is substantially half that of FIG. 2 while an alert is being displayed. Line 70 of FIG. 3 shows that the duty cycle of the low cell interruption is substantially one quarter that of FIG. 2 while message information is being displayed.

FIGS. 2 and 3 show that information normally displayed without interruption when a low cell state does not exist, is interrupted by a low cell display when the low cell state does exist. Additionally, the amount of time the low cell is displayed on the display increases as the capacity of the battery is depleted, thereby providing the user an indication of the remaining capacity and the amount of time before the cell must be either replaced or recharged. In the preferred embodiment, the interruption has a substantially one second period, and the duration or duty cycle of the interruption varies linearly with the remaining capacity. For example, in alternate embodiments, the relationship between the timing of the interruption need not be linear, and may be in discreet steps or may geometrically approach a predetermined value or may vary in an arbitrary manner. Furthermore, the timing may vary either the period or the duty cycle or both period and duty cycle, and may use different beginning and ending predetermined timings.

The interruption of the low cell display further varies with respect t the type of information being displayed. When message information is being displayed the interruption is substantially less than the interruption of the display of time, thereby giving the user more opportunity to ascertain the message information.

Figure 4:
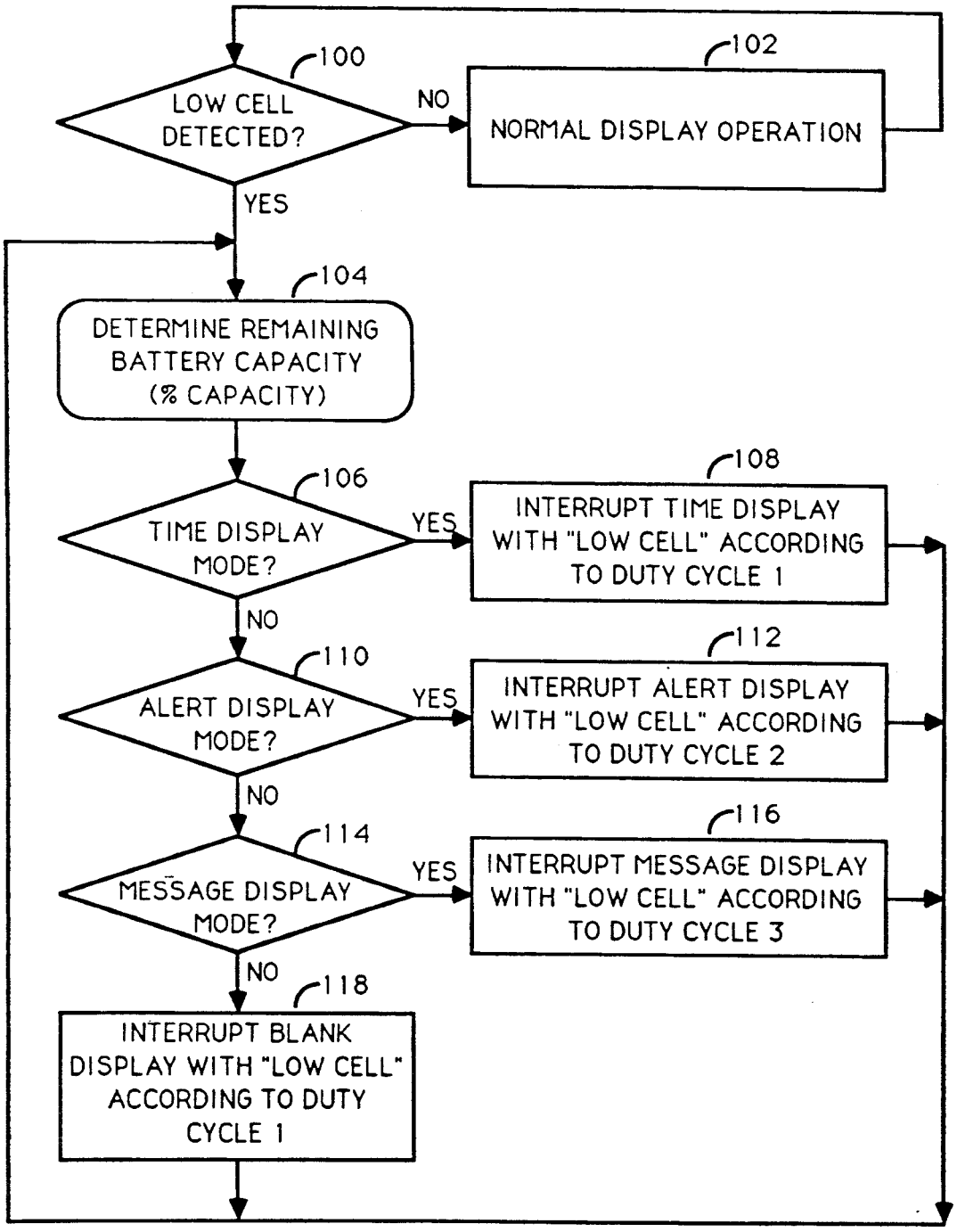
FIG. 4 shows a flowchart of the overall operation of the invention within the device.
Figure 7:
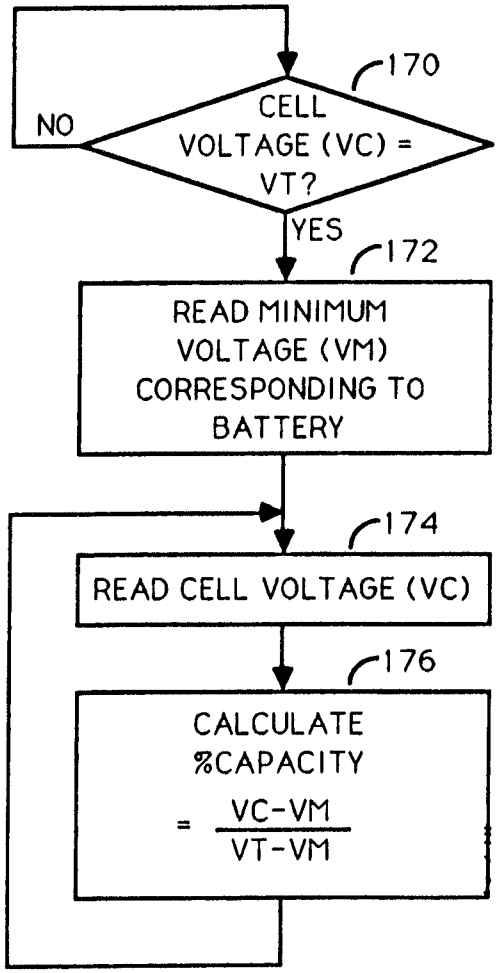
FIG. 7 shows a flowchart for determining the remaining capacity of the battery in response to a second embodiment of the invention.
Figure 6:
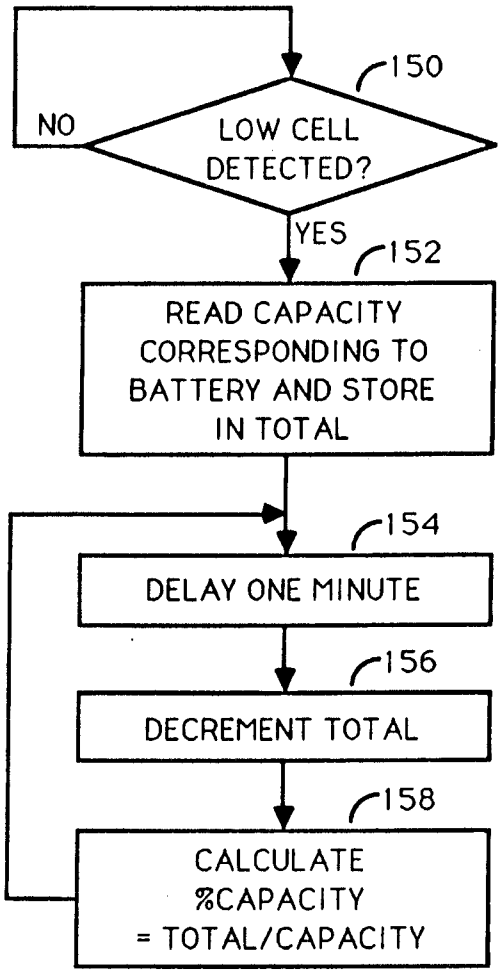
FIG. 6 shows a flowchart for determining the remaining capacity of the battery in response to a first embodiment of the invention.
Figure 8:
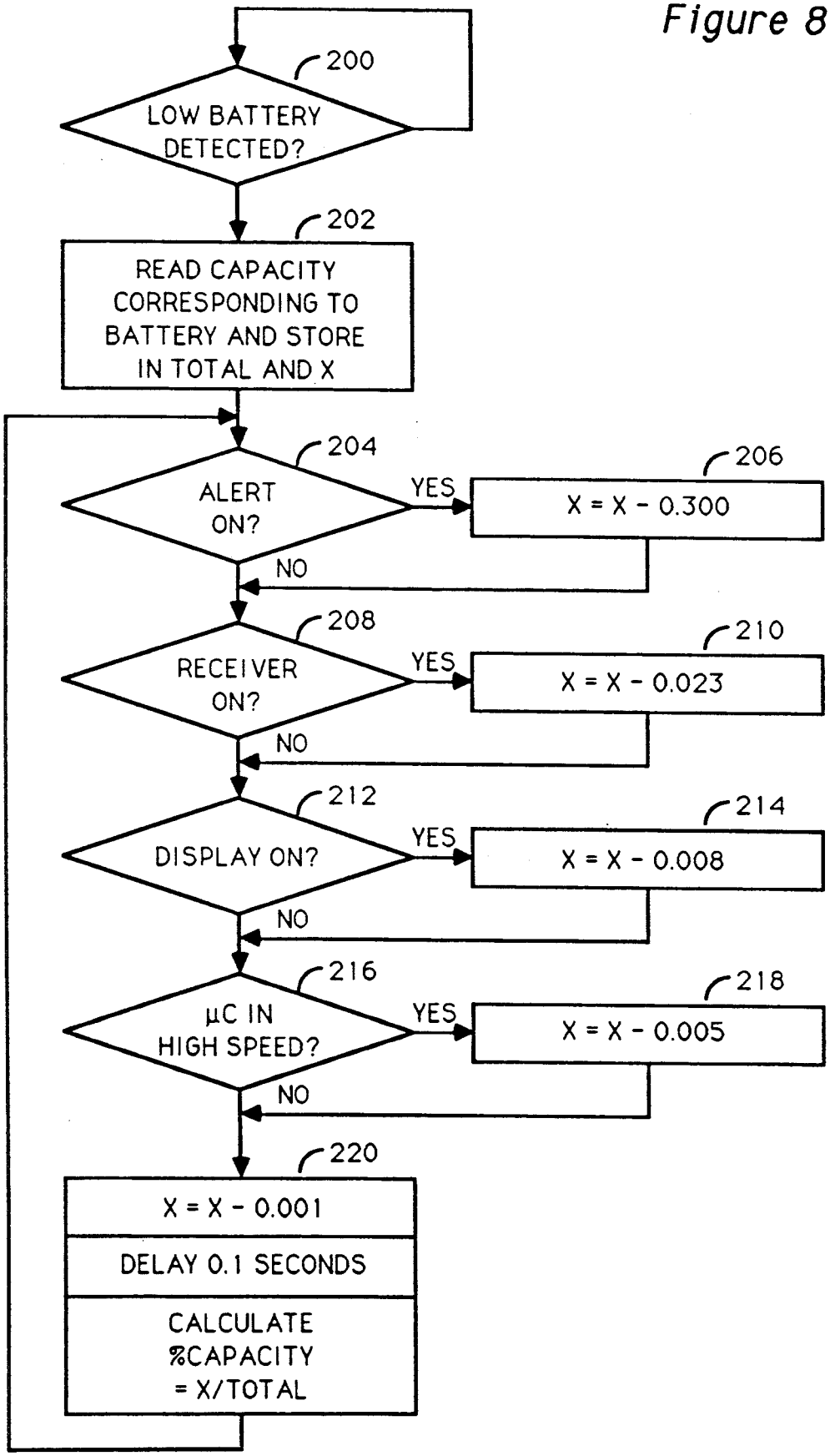
FIG. 8 shows a flowchart for determining the remaining capacity of the battery in response to a third embodiment of the invention.

FIG. 4 shows a flowchart of the overall operation of the invention within the device. The routine of FIG. 4 effectively operates continuously in a multi-tasking software environment within the microcomputer. Step 100 checks if the low cell has been detected. If not, normal display operations, step 102, are performed. This includes selecting the type of information to be displayed on the display, or to blank the display in order to conserve power. If a low cell is detected, step 104 determines the remaining capacity of the battery. FIGS. 6, 7 and 8 show contemplated methods for determining the remaining capacity. Then step 106 determines if the time is being displayed. If true, step 108 interrupts the time display with a low cell display corresponding to a first duty cycle as indicated by FIG. 2. If false, step 110 determines if an alert is being displayed. The alert may be displayed either in response to a received message or in response to an alarm set on the clock being in coincidence with the time of day. If true, step 112 interrupts the alert display with a low cell display corresponding to a second duty cycle as indicated by line 60 of FIG. 3. If false, step 114 determines if message information is being displayed. If true, step 116 interrupts the message display with a low cell display corresponding to a third duty cycle as indicated by line 70 of FIG. 3. If false, step 118 assumes the blank display is selected and interrupts the blank display with a low cell display corresponding to the first duty cycle as indicated by FIG. 2. From either step 108, 112, 116 or 118, the flowchart returns to step 104 to continuously determine the remaining capacity. Thus FIG. 4 shows interruption with a low cell display varies with determined battery capacity and with the type of information being displayed. The type of information displayed is selected in response to the selecting means 29 or in response to a received message or a time of day alarm.

Figure 5:
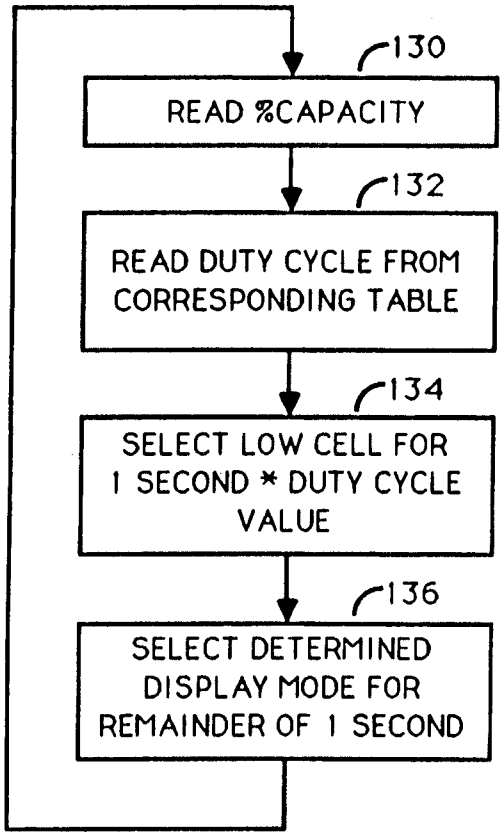
FIG. 5 shows a flowchart for varying the duty cycle in each display mode.

FIG. 5 shows a flowchart for varying the duty cycle in each display mode. The routine of FIG. 5 effectively operates continuously in a multi-tasking software environment within the microcomputer and represents the interruptions described in steps 108, 112, 116 and 118 of FIG. 4. In step 130 the capacity determined in step 104 is read. The step 132 reads the duty cycle from the the table identified by either steps 108, 112, 116 or 118. Then step 134 selects the low cell display for a fraction of a second. The duration of the low cell display produces the duty cycle of identified table. Then step 136 selects the determined display mode for the remainder of the second.

FIG. 6 shows a flowchart for determining the remaining capacity of the battery in response to a first embodiment of the invention. The routine of FIG. 6 effectively operates continuously in a multi-tasking software environment within the microcomputer. First in step 150 it is determined if a low cell is detected. If true, and step 152 reads the capacity value from the code plug corresponding to the battery being used and stores the value in a register named total. Then step 154 delays one minute, and step 156 decrements the register total. Then step 158 determines the % capacity = the ratio of the total register and the capacity value read from the code plug. Thus the embodiment of FIG. 6 shows the capacity decreasing linearly with time, wherein the code plug holds a value corresponding to the expected time until the capacity of the battery is substantially depleted.

FIG. 7 shows a flowchart for determining the remaining capacity of the battery in response to a second embodiment of the invention. The routine of FIG. 7 effectively operates continuously in a multi-tasking software environment within the microcomputer. First step 170 determines if the cell voltage (Vc) is equal to a value threshold voltage value (Vt). If true, a low cell is detected and step 172 reads a minimum voltage value (Vm) from the code plug corresponding to the battery being used. Then in step 174, the cell voltage (Vc) is read and step 76 calculates the % capacity as a function of Vc, Vt, and Vm. Thus, in this embodiment, the remaining capacity is determined in response to the voltage of the battery, a threshold value and a minimum value. The code plug may include both the threshold value and the minimum value used in the determination of the low cell condition and the remaining battery capacity.

FIG. 8 shows a flowchart for determining the remaining capacity of the battery in response to a third embodiment of the invention. The routine of FIG. 8 effectively operates continuously in a multi-tasking software environment within the microcomputer. First in step 200 it is determined if a low cell is detected. This step corresponds to steps 100, 150 and 170 of FIGS. 4, 6 and 7 respectively which all have true determinations in response to substantially the same conditions. If step 200 is true, step 202 reads the capacity value corresponding to the battery being used and stores the value in registers named total and X. Then in step 204, it is determined if the alert is on, if true, a value of .300 is subtracted from X in step 206. Then step 208 checks if the receiver is on, in response to which 0.023 is subtracted from X in step 210. Then step 212 checks if the display is active, in response to which 0.008 is subtracted from X in step 214. Then step 216 checks if the microcomputer is in a high current mode, in response to which 0.005 is subtracted from X in step 218. Then in step 220, 0.001 is subtracted from X. The flowchart then delays for 0.1 seconds and the % capacity is calculated to be the ratio of the value X and total. In this embodiment, the numbers subtracted from X substantially correspond to the expected power consumption of the devices which are active. The capacity value is held in the code plug and the values subtracted from X may also be held in the code plug and determined in response to measured performance of the device.

It will be appreciated that the invention has been described above by way of example only and that modifications to the above may be made without departing from the spirit and scope of the invention. Although the device has been described in the context of a wrist watch pager, the invention may be applied independently to either a wrist watch or a pager, or any display device having a varying electrical condition. Additionally values stored in the code plug may be either received or modified in response to information received in the message information. Alternately, the values may be predetermined and stored in microcomputer ROM. Furthermore in embodiment wherein the display means 28 includes a separate icon for indicating a low cell condition the changing of the duty cycle need not vary with the type of information being displayed, since the low cell indication doesn't displace the display of other information.

What is claimed is:

1. An information display device comprising:

display means for displaying first information:

sensing means for sensing an electrical signal having a varying electrical condition and for producing a capacity signal in response thereof; and interrupting means, responsive to the capacity signal and having variable timing, for periodically preventing the displaying of the first information and for displaying of second information when the first information is being prevented from being displayed, whereby the variable timing of the interrupting means changes to indicate the status of the varying electrical condition.

2. The information display device according to claim 1 wherein the timing includes period and duty cycle characteristics and varying the timing includes varying the duty cycle.

3. The information display device according to claim 1 wherein the timing includes period and duty cycle characteristics and varying the timing includes varying the period.

4. The information display device of claim 1 further comprising a battery for powering the information display device and the varying electrical condition corresponds to the remaining electrical capacity of said battery.

5. The information display device of claim 4 wherein second information includes a readable signal indicating that the remaining electrical capacity of said battery is substantially depleted.

6. The information display device according to claim 1 further comprising inhibiting means for inhibiting said interrupting means from preventing said display means in response to the varying electrical condition being greater than a predetermined value.

7. The information display device according to claim 6 further comprising an alerting means for generating an audio alert in response to the determination by said inhibiting means that the electrical signal is less than the predetermined value.

8. The information display device according to claim 6 wherein said sensing means generates the capacity signal in response to the elapsed time since the determination by said inhibiting means that the electrical signal is less than the predetermined value.

9. The information display device according to claim 6 further comprising a battery for powering said information display device, and the varying electrical condition corresponds to the remaining electrical capacity of said battery and the predetermined value corresponds to a predetermined voltage.

10. The information display device according to claim 9 wherein said sensing means generates the capacity signal in response to the voltage of said battery.

11. The information display device according to claim 9 further comprising a means for determining the power consumed from said battery, wherein said sensing means generates the capacity signal in response to the power consumed from said battery.

12. The information display device according to claim 9 further comprising a programmable nonvolatile memory means having a value substantially indicative of the battery capacity remaining within said battery upon detection by said inhibiting means of the electrical signal being less than the predetermined value.

13. The information display device according to claim 1 wherein the information display device includes a selective call receiver including:

receiving means for receiving and demodulation message information modulated upon a radio frequency carrier, said receiving means periodically activating and deactivating while receiving and demodulating message information, wherein said sensing means modifies the capacity signal by a first amount in response to said receiving means being active during a first time period or by a second amount in response to the receiving means being inactive during the first time period.

14. The information display device according to claim 13 further comprising:

decoding means for selectively processing the demodulated message information, and for operating in a reduced power mode in response to said receiving means being inactivated, wherein said sensing means modifies the capacity signal by a third amount in response to said decoding means processing the demodulated information during a second time period or by a fourth amount in response to the decoding means operating in a reduced power mode during the second time period.

15. The information display device according to claim 14 further said decoding means includes a microcomputer.

16. The information display device according to claim 14 further comprising:

alert means for being active while alerting the reception of message information received on the radio frequency carrier and for operating in a reduced power state when inactive, wherein said sensing means modifies the consumption signal by a fifth amount in response to said alert means being active during a fourth time period or by a sixth amount in response to the alert means being inactive during the fourth time period.

17. The information display device according to claim 1 wherein said first information includes a plurality of information types, and, said display means selectively displays one of a plurality of information types; and said interrupting means further varies the time of the displaying of the second information in response to the information type being displayed on said display means.

18. The information display device according to claim 17 further comprising a time keeping means and one of the plurality of information types includes information indicative of the time of day.

19. The information display device according to claim 18 wherein the time keeping means further includes alarm means for determining if the time of day corresponds to a predetermined time, and one of said plurality of information types includes information responsive to said alarm means for indicating the determination.

20. The information display device according to claim 17 further comprising:

receiving means for receiving messages modulated upon a radio frequency carrier; and storage means for storing the received messages, wherein one of the plurality of information types includes information received by said receiving means.

21. The information display device according to claim 20 wherein the messages include an address signal and said device further comprises:

decoding means for detecting an address signal matching a predetermined address signal assigned to said device, wherein said storage means stores a received message in response thereof; and alerting means for generating an alert in response to said detection, wherein one of said plurality of information types includes information indicative of said detection.

22. A method for indicating the status of an electrical signal upon an information display device, the method comprising the steps of:

displaying first information;

sensing an electrical signal having a varying electrical condition and producing a capacity signal in response thereof; and periodically preventing, in response to the capacity signal and having variable timing, the displaying of the first information and for displaying of second information when the first information is being prevented from being displayed, whereby the variable timing of the periodical preventing changes to indicate the status of the varying electrical condition.

23. A method for indicating the status of an electrical signal upon an information display device, the method comprising the steps of:

sensing an electrical signal having a varying electrical condition;

generating a threshold signal in response to the varying electrical condition exceeding a predetermined condition;

displaying first information on a display means;

interrupting the displaying of the first information on said display means with a displaying of second information at a first rate in response to the threshold signal;

displaying third information on said display means; and interrupting the displaying of the third information on said display means with a displaying of second information at a second rate different from the first rate in response to the threshold signal.

24. The method according to claim 23 wherein the electrical signal is generated by a battery having a limited capacity, and the method further comprising the step of determining the remaining capacity of the battery and wherein the first and second rates of said steps of interrupting are varied in response to said step of determining.

* * * * *